US009217205B2

(12) United States Patent
Abys et al.

(10) Patent No.: US 9,217,205 B2
(45) **Date of Patent: *Dec. 22, 2015**

(54) ELECTROLYTIC DEPOSITION OF METAL-BASED COMPOSITE COATINGS COMPRISING NANO-PARTICLES

(75) Inventors: Joseph A. Abys, Guilford, CT (US); Edward J. Kudrak, Jr., Morganville, NJ (US); Jingye Li, West Haven, CT (US); Chen Xu, New Providence, NJ (US); Chonglun Fan, Portland, OR (US)

(73) Assignee: Enthone Inc., West Haven, CT (US)

( * ) Notice: Subject to any disclaimer, the term of this patent is extended or adjusted under 35 U.S.C. 154(b) by 35 days.

This patent is subject to a terminal disclaimer.

(21) Appl. No.: 12/747,681

(22) PCT Filed: Dec. 10, 2008

(86) PCT No.: PCT/US2008/086210

§ 371 (c)(1),
(2), (4) Date: Jul. 19, 2010

(87) PCT Pub. No.: WO2009/076430

PCT Pub. Date: Jun. 18, 2009

(65) Prior Publication Data

US 2010/0294669 A1 Nov. 25, 2010

Related U.S. Application Data

(60) Provisional application No. 61/012,809, filed on Dec. 11, 2007.

(51) Int. Cl.
*C25D 15/02* (2006.01)
*C25D 3/02* (2006.01)

(52) U.S. Cl.
CPC . *C25D 15/02* (2013.01); *C25D 3/02* (2013.01)

(58) Field of Classification Search
USPC ..... 205/109
See application file for complete search history.

(56) References Cited

U.S. PATENT DOCUMENTS

| | | | | |
|---|---|---|---|---|
| 4,098,654 | A * | 7/1978 | Helle et al. | 205/50 |
| 4,728,398 | A * | 3/1988 | Paulet et al. | 205/109 |
| 5,028,492 | A | 7/1991 | Guenin | |
| 5,853,557 | A * | 12/1998 | Souza et al. | 205/109 |
| 6,274,254 | B1 * | 8/2001 | Abys et al. | 428/670 |
| 6,447,167 | B1 * | 9/2002 | Kashiwada et al. | 384/100 |
| 6,635,166 | B2 * | 10/2003 | Saji et al. | 205/109 |
| 6,818,116 | B2 | 11/2004 | Stoffer et al. | |
| 6,835,449 | B2 | 12/2004 | Kim et al. | |
| 7,638,581 | B2 | 12/2009 | Jing et al. | |
| 8,226,807 | B2 * | 7/2012 | Abys et al. | 205/109 |
| 2006/0225605 | A1 | 10/2006 | Kloeckener et al. | |

FOREIGN PATENT DOCUMENTS

| | | | |
|---|---|---|---|
| GB | 1331529 | A * | 9/1973 |
| JP | S54-159342 | | 12/1979 |
| JP | 2002348699 | | 12/2002 |
| WO | WO 98/23444 | A1 * | 6/1998 |

OTHER PUBLICATIONS

Dupont Zonyl Fluoroadditives Ink and Coating Guide, Oct. 2000, obtained at https://web.archive.org/web/20001028051525/http://www.dupont.com/teflon/fluoroadditives/products/pdf/inkcoatgd.pdf.*

International Preliminary Report on Patentability, PCT/US2008/086210, dated Jun. 15, 2010, 8 page.

International Search Report, PCT/US2008/086210, dated Feb. 5, 2009, 1 page.

Written Opinion, PCT/US2008/086210, dated Feb. 5, 2009, 6 page.

* cited by examiner

*Primary Examiner* — Harry D Wilkins, III
(74) *Attorney, Agent, or Firm* — Senniger Powers LLP

(57) ABSTRACT

A method is provided for imparting corrosion resistance onto a surface of a substrate. The method comprises contacting the surface of the substrate with an electrolytic plating solution comprising (a) a source of deposition metal ions of a deposition metal selected from the group consisting of zinc, palladium, silver, nickel, copper, gold, platinum, rhodium, ruthenium, chrome, and alloys thereof, (b) a pre-mixed dispersion of non-metallic nano-particles, wherein the non-metallic particles have a pre-mix coating of surfactant molecules thereon; and applying an external source of electrons to the electrolytic plating solution to thereby electrolytically deposit a metal-based composite coating comprising the deposition metal and non-metallic nano-particles onto the surface.

30 Claims, No Drawings

ELECTROLYTIC DEPOSITION OF METAL-BASED COMPOSITE COATINGS COMPRISING NANO-PARTICLES

REFERENCE TO RELATED APPLICATIONS

This application is the U.S. national stage application of International Patent Application No. PCT/US2008/086210 filed Dec. 10, 2008 and claims the benefit of US Provisional Application No. 61/012,809, filed Dec. 11, 2007.

FIELD OF THE INVENTION

This invention relates generally to the electrolytic deposition of metals and metal alloys. More particularly, the invention relates to the electrolytic deposition of metal-based composite coatings comprising non-metallic nano-particles to enhance the functional properties of surfaces.

BACKGROUND OF THE INVENTION

The corrosion of metals begins with the adsorption of small amounts of water onto metal surfaces. Wetting provides the means for transport of environmental acids, halides, and other corrosive materials. A hydrophobic surface which is water repellent inhibits the adsorption of environmental moisture and significantly reduces corrosion of a plated metal deposit and the underlying layers or substrate.

Fluorinated polymers such as polytetrafluoroethylene (marketed under the trade name TEFLON®) are known for imparting hydrophobicity on a surface and thus imparting water repellency. Fluorinated polymers are typically applied to a metal surface as particles, which are sintered together by baking at high temperatures.

Recently, methods have been developed to directly deposit fluorinated polymer particles into a metal-based composite coating, which avoid the high temperature sintering of fluoropolymer particles. For example, Henry et al. (U.S. Pat. No. 4,830,889) and Feldstein (U.S. Pat. No. 5,721,055) describe the co-deposition of fluorinated polyethylene and nickel from electroless nickel plating baths. See also Kobayashi et al. (U.S. Pat. No. 6,878,461).

As distinguished from electroless processes, Abys et al. (U.S. Pat. No. 6,274,254) disclose a method for co-depositing Pd, Co, and PTFE by electrolytic plating to increase the wear resistance of electrical connectors.

An electrolytically plated metal-based composite coating comprising PTFE particles having diameters comparable to the wavelengths of visible light (i.e., from about 380 nm to about 780 nm) produces a dark gray, matte surface. Such alloys make poor finishes in decorative and electronics applications, such as, for example, decorative automotive parts and electronics connectors, where surface appearance is either desired for cosmetic reasons or required for performance such as wear resistance. Additionally, composite coatings comprising relatively large PTFE particles repel water to varying degrees based on the particle size distribution, concentration of occluded particles, and surface to volume ratio of the particles that are incorporated. Moreover, large size particles may not be evenly distributed in the metal-based composite coating.

Therefore, a need continues to exist for a plating process which yields a metal-based composite coating having a smooth, bright, glossy finish, a high degree of water repellency and corrosion resistance, and a lubricious surface that improves wear resistance without affecting the appearance of deposit.

SUMMARY OF THE INVENTION

Among the various aspects of the present invention, therefore may be noted the provision of an electrolytic metal deposition process which yields a metal-based composite coating having a high degree of water repellency, corrosion resistance, wear resistance, and which also lowers the coefficient of friction and insertion forces.

Briefly, therefore, the present invention is directed to a method for imparting corrosion resistance onto a surface of a substrate. The method comprises contacting the surface of the substrate with an electrolytic plating solution comprising (a) a source of deposition metal ions of a deposition metal selected from the group consisting of zinc, palladium, silver, nickel, copper, gold, platinum, rhodium, ruthenium, chrome, and alloys thereof, (b) a pre-mixed dispersion of non-metallic nano-particles having a mean particle size between about 10 and about 500 nanometers, wherein the non-metallic nano-particles have a pre-mix coating of surfactant molecules thereon; and applying an external source of electrons to the electrolytic plating solution to thereby electrolytically deposit a metal-based composite coating comprising the deposition metal and non-metallic nano-particles onto the surface.

The present invention is further directed to a method for imparting corrosion resistance onto a surface of a substrate. The method comprises contacting the metal surface with an electrolytic plating composition comprising (a) a source of deposition metal ions of a deposition metal selected from the group consisting of zinc, palladium, silver, nickel, copper, gold, platinum, rhodium, ruthenium, chrome, and alloys thereof, and (b) non-metallic particles having surfactant coatings, wherein the surfactant coatings have an average charge per surfactant molecule of between +0.1 and +1; and applying an external source of electrons to the electrolytic plating composition to thereby electrolytically deposit the composite coating onto the metal surface, wherein the composite coating comprises the deposition metal and the non-metallic particles.

The present invention is still further directed to a method for imparting corrosion resistance onto a surface of a substrate. The method comprises contacting the metal surface with an electrolytic plating composition comprising (a) a source of deposition metal ions of a deposition metal selected from the group consisting of zinc, palladium, silver, nickel, copper, gold, platinum, rhodium, ruthenium, chrome, and alloys thereof, and (b) a pre-mixed dispersion of non-metallic nano-particles having a mean particle size between about 10 and about 500 nanometers, wherein the non-metallic nano-particles have a pre-mix coating of surfactant molecules thereon; and applying an external source of electrons to the electrolytic plating composition to thereby electrolytically deposit the composite coating onto the metal surface, wherein the composite coating comprises the deposition metal and between about 1 wt. % and about 5 wt. % of the non-metallic nano-particles.

The present invention is still further directed to a method for imparting corrosion resistance onto a surface of a substrate. The method comprises contacting the metal surface with an electrolytic plating composition comprising (a) a source of deposition metal ions of a deposition metal selected from the group consisting of zinc, palladium, silver, nickel, copper, gold, platinum, rhodium, ruthenium, chrome, and alloys thereof, and (b) non-metallic nano-particles, wherein the non-metallic nano-particles are characterized by a particle size distribution in which at least about 30 volume % of the particles have a particle size less than 100 nm; and applying an external source of electrons to the electrolytic plating composition to thereby electrolytically deposit the composite coating onto the metal surface, wherein the composite coating comprises the deposition metal and the non-metallic nano-particles.

Other objects and aspects of the invention will be, in part, pointed out and, in part, apparent hereinafter.

DETAILED DESCRIPTION OF THE EMBODIMENT(S) OF THE INVENTION

In accordance with the present invention, a metal-based composite coating having enhanced surface properties is electrolytically deposited on a surface of a substrate. The enhanced surface properties include high degree of water repellency, corrosion resistance, hardness, wear resistance, and lubricity. Moreover, the surface coating may also be characterized by reduced coefficient of friction. The metal-based composite coating is especially attractive for coating a connector surface since a connector coated with the metal-based composite coating requires reduced insertion force, which decreases wear.

The metal-based composite coating of the present invention may be applied to and protect a variety of substrates. Substrates for coating with the metal-based composite coatings of the present invention include connectors and other electronics parts, automotive parts, metallized plastics, and non-stick parts for use in injection molding tools.

Exemplary metals for electrolytic deposition in the metal-based composite coating include zinc, palladium, silver, nickel, copper, gold, platinum, rhodium, ruthenium, chrome (decorative and hard) and alloys containing any of these metals. Tin and tin alloys are alternatively suitable. In one embodiment, the metal-based composite coating is a copper alloy. Exemplary copper alloys include Cu—Sn—Zn bronze and Cu—Sn bronze.

The enhanced surface features of the metal-based composite coating are due to co-deposition of the metal(s) with non-metallic nano-particles. By incorporating non-metallic nano-particles having a mean particle size smaller than the wavelengths of visible light into the metal-based composite coatings of the present invention, the advantages of increased water repellency, corrosion resistance, hardness, wear resistance, and lubricity are obtained without any impact on the coatings' appearance. In other words, an electrolytic deposition method that yields a bright, glossy coating without non-metallic nano-particles yields a bright, glossy coating with non-metallic nano-particles. Likewise, an electrolytic deposition method that yields a semi-bright coating without non-metallic nano-particles yields a semi-bright coating with non-metallic nano-particles.

One class of non-metallic nano-particles for inclusion in the metal-based composite coatings of the present invention is non-metallic nano-particles composed of a fluoropolymer. The fluoropolymer may be selected from among polytetrafluoroethylene (PTFE, fluorinated ethylene-propylene copolymer (FEP), perfluoroalkoxy resin (PFE, a copolymer of tetrafluoroethylene and perfluorovinylethers), ethylene-tetrafluoroethylene copolymer (ETFE), polychlorotrifluoroethylene (PCTFE), ethylene-chloro-trifluoroethylene copolymer (ECTFE), polyvinylidene fluoride (PVDF), and polyvinyl fluoride (PVF), with polytetrafluoroethylene currently preferred. In a preferred embodiment, the nano-particles are PTFE particles.

The mean particle size of the non-metallic nano-particles composed of fluoropolymer is preferably on the order of or substantially smaller than the wavelength of visible light i.e., less than 380 nm (0.38 μm) to 780 nm (0.780 μm). The mean particle size is less than about 0.50 μm (500 nm), typically less than about 0.25 μm (250 nm), more typically less than about 0.20 μm (200 nm), and even more typically less than about 0.15 μm (150 nm). The mean particle size is greater than 0.005 μm (5 nm), typically greater than about 0.01 μm (10 nm), more typically greater than about 0.05 μm (50 nm). Accordingly, the mean particle size may be between about 0.50 μm (500 nm) and about 0.005 μm (5 nm), preferably between about 0.20 μm (200 nm) and about 0.01 μm (10 nm), such as between about 0.150 μm (150 nm) and about 0.05 μm (50 nm). In one embodiment, the non-metallic nano-particles have a mean particle size between about 0.05 μm (50 nm) and about 0.1 μm (100 nm). In one embodiment, the non-metallic nano-particles have a mean particle size between about 0.01 μm (10 nm) and about 0.05 μm (50 nm). In a preferred embodiment, the non-metallic nano-particles have a mean particle size may have particle sizes of about 0.08 μm (80 nm) and about 0.05 μm (50 nm).

The mean particle sizes stated above refer to the arithmetic mean of the diameter of particles within a population of fluoropolymer particles. A population of non-metallic nano-particles contains a wide variation of diameters. Therefore, the particles sizes may be additionally described in terms of a particle size distribution, i.e., a minimum volume percentage of particles having a diameter below a certain limit. In one embodiment, therefore, at least about 50 volume % of the particles have a particle size less than 200 nm, preferably at least about 70 volume % of the particles have a particle size less than 200 nm, more preferably at least about 80 volume % of the particles have a particle size less than 200 nm, and even more preferably at least about 90 volume % of the particles have a particle size less than 200 nm.

In another embodiment, at least about 30 volume % of the particles have a particle size less than 100 nm, preferably at least about 40 volume % of the particles have a particle size less than 100 nm, more preferably at least about 50 volume % of the particles have a particle size less than 100 nm, and even more preferably at least about 60 volume % of the particles have a particle size less than 100 nm.

In a further embodiment, at least about 25 volume % of the particles have a particle size less than 90 nm, preferably at least about 35 volume % of the particles have a particle size less than 90 nm, more preferably at least about 45 volume % of the particles have a particle size less than 90 nm, and even more preferably at least about 55 volume % of the particles have a particle size less than 90 nm.

In another embodiment, at least about 20 volume % of the particles have a particle size less than 80 nm, preferably at least about 30 volume % of the particles have a particle size less than 80 nm, more preferably at least about 40 volume % of the particles have a particle size less than 80 nm, and even more preferably at least about 50 volume % of the particles have a particle size less than 80 nm.

In another embodiment, at least about 10 volume % of the particles have a particle size less than 70 nm, preferably at least about 20 volume % of the particles have a particle size less than 70 nm, more preferably at least about 30 volume % of the particles have a particle size less than 70 nm, and even more preferably at least about 35 volume % of the particles have a particle size less than 70 nm.

The fluoropolymer particles employed in the present invention have a so-called "specific surface area" which refers to the total surface area of one gram of particles. As particle size decreases, the specific surface area of a given mass of particles increases. Accordingly, smaller particles as a general proposition provide higher specific surface areas.

And the relative activity of a particle to achieve a particular function is in part a function of the particle's surface area in the same manner that a sponge with an abundance of exposed surface area has enhanced absorbance in comparison to an object with a smooth exterior. The present invention employs particles with surface area characteristics to facilitate achieving particular corrosion-inhibiting function as balanced against various other factors. In particular, these particles have surface area characteristics which permit the use of a lower concentration of nano-particles in solution in certain embodiments, which promotes solution stability, and even particle distribution and uniform particle size in the deposit. Although it is contemplated that greater PTFE concentration might be addressed by plating process modifications, the particular surface characteristics of this preferred embodiment require addressing stability and uniformity issues to a substantially lesser degree. Moreover, it preliminarily appears possible that higher concentrations of particles such as PTFE may have deleterious effects on hardness or ductility; and if this turns out to be true, then the preferred surface area characteristics help avoid this.

In one embodiment, the invention employs fluoropolymer particles where at least about 50 wt %, preferably at least about 90 wt %, of the particles have a specific surface area of at least about 15 $m^2/g$ (e.g., between 15 and 35 $m^2/g$. The specific surface area of the fluoropolymer particles may be as high as about 50 $m^2/g$, such as from about 15 $m^2/g$ to about 35 $m^2/g$. The particles employed in this preferred embodiment of the invention, in another aspect, have a relatively high surface-area-to-volume ratio. These nano-sized particles have a relatively high percent of surface atoms per number of atoms in a particle. For example, a smaller particle having only 13 atoms has about 92% of its atoms on the surface. In contrast, a larger particle having 1415 total atoms has only 35% of its atoms on the surface. A high percentage of atoms on the surface of the particle relates to high particle surface energy, and greatly impacts properties and reactivity. Nanoparticles having relatively high specific surface area and high surface-area-to-volume ratios are advantageous since a relatively smaller proportion of fluoropolymer particles may be incorporated into the composite coating compared to larger particles, which require more particles to achieve the same surface area, and still achieve the effects of increased corrosion resistance. On the other hand, the higher surface activity prevents certain substantial challenges, such as uniform dispersion. Accordingly, as little as 10 wt. % fluoropolymer particle in the composite coating achieves the desired effects, and in some embodiments, the fluoropolymer particle component is as little as 5 wt. %, such as between about 1 wt. % and about 5 wt %. A relatively purer coating may be harder and more ductile than a coating comprising substantially more fluoropolymer particle; however, the desired characteristics are not compromised by incorporating relatively small amounts of nano-particles in the composite coating.

The non-metallic nano-particles are dispersed in a solvent system that inhibits agglomeration. The solvent for electrolytic compositions is typically water. Since many of the nano-particles are hydrophobic, nano-particles dispersed in water tend to agglomerate into clumps having mean particle sizes greater than the mean particle size of the nano-particles individually. This is disadvantageous from a cosmetic standpoint. Whereas a metal-based composite coating comprising agglomerated nano-particles has the above-described advantages of water repellency, corrosion resistance, hardness, wear resistance, and lubricity, the larger agglomerated nano-particles negatively impact the appearance of the metal-based composite coating. In other words, a metal-based composite coating that is glossy without the nano-particles may be matte if it contains agglomerated clumps of nano-particles. Accordingly, the solvent system for dispersing the nano-particles comprises surfactants to inhibit agglomeration of the nano-particles in aqueous solution.

Surfactants are added to the electrolytic plating composition to additionally promote wetting of the substrate surface and modify the surface tension of the electrolytic plating solution to between about 40 dyne-cm and about 70 dyne-cm. With regard to the plating process, a low surface tension is advantageous to enhance wetting of the substrate surface; enhance the ability of the solution to get rid of gas bubbles; and prevent pits/voids on the surface; increases the solubility of organic materials such as grain refiners, brighteners, and other bath additives; and lowers the deposition potentials of various metals which allows for uniform deposits and alloys. A lower surface tension is advantageous with regard to the non-metallic nano-particles because this enhances the dispersability of the non-metallic nano-particles in the plating composition.

Fluoropolymer particles are commercially available in a form which is typically dispersed in a solvent. An exemplary source of dispersed fluoropolymer particles includes Teflon® PTFE 30 (available from DuPont), which is a dispersion of PTFE particles on the order of the wavelength of visible light or smaller. That is, PTFE 30 comprises a dispersion of PTFE particles in water at a concentration of about 60 wt. % (60 grams of particles per 100 grams of solution) in which the particles have a particle size distribution between about 50 and about 500 nm, and a mean particle size of about 220 nm. Another exemplary source of dispersed fluoropolymer particles include Teflon® TE-5070AN (available from DuPont), which is a dispersion of PTFE particles in water at a concentration of about 60 wt. % in which the particles have a mean particle size of about 80 nm. These particles are typically dispersed in a water/alcohol solvent system. Generally, the alcohol is a water soluble alcohol, having from 1 to about 4 carbon atoms, such as methanol, ethanol, n-propanol, iso-propanol, n-butanol, iso-butanol, and tert-butanol. Typically, the ratio of water to alcohol (mole:mole) is between about 10 moles of water and about 20 moles of water per one mole of alcohol, more typically between about 14 moles of water and about 18 moles of water per one mole of alcohol.

Alternatively, a solution from a source of dry PTFE particles may be prepared and then added to the electrolytic plating bath. An exemplary source of dry PTFE particles is Teflon® TE-5069AN, which comprises dry PTFE particles having a mean particle size of about 80 nm. Other sources of PTFE particles include those sold under trade name Solvay Solexis available from Solvay Solexis of Italy, and under the trade name Dyneon available from 3M of St. Paul, Minn. (U.S.).

Preferably, the fluoropolymer particles are added to the electrolytic deposition composition with a pre-mix coating, i.e., as a coated particle, in which the coating is a surfactant coating applied prior to combining the non-metallic nano-particles with the other components (i.e., deposition metal ions, acid, water, anti-oxidants, etc.) of the electrolytic deposition composition. The surfactants used to coat the non-metallic nano-particles may also be added to the electrolytic composition to decrease the surface tension of the composition. The fluoropolymer particles may be coated with surfactant in an aqueous dispersion by ultrasonic agitation and/or high pressure streams. The dispersion comprising fluoropolymer particles having a surfactant coating thereon may be then added to the electrolytic plating composition. The surfactant coating inhibits agglomeration of the particles and enhances the solubility/dispersability of the fluoropolymer particles and hollow microspheres in solution.

The surfactant may be cationic, anionic, non-ionic, or zwitterionic. A particular surfactant may be used alone or in combination with other surfactants. One class of surfactants comprises a hydrophilic head group and a hydrophobic tail. Hydrophilic head groups associated with anionic surfactants include carboxylate, sulfonate, sulfate, phosphate, and phosphonate. Hydrophilic head groups associated with cationic surfactants include quaternary amine, sulfonium, and phosphonium. Quaternary amines include quaternary ammonium, pyridinium, bipyridinium, and imidazolium. Hydrophilic head groups associated with non-ionic surfactants include alcohol and amide. Hydrophilic head groups associated with zwitterionic surfactants include betaine. The hydrophobic tail typically comprises a hydrocarbon chain. The hydrocarbon chain typically comprises between about six and about 24 carbon atoms, more typically between about eight to about 16 carbon atoms.

Exemplary anionic surfactants include alkyl phosphonates, alkyl ether phosphates, alkyl sulfates, alkyl ether sulfates, alkyl sulfonates, alkyl ether sulfonates, carboxylic acid ethers, carboxylic acid esters, alkyl aryl sulfonates, and sulfosuccinates. Anionic surfactants include any sulfate ester, such as those sold under the trade name ULTRAFAX, including, sodium lauryl sulfate, sodium laureth sulfate (2 EO), sodium laureth, sodium laureth sulfate (3 EO), ammonium lauryl sulfate, ammonium laureth sulfate, TEA-lauryl sulfate, TEA-laureth sulfate, MEA-lauryl sulfate, MEA-laureth sulfate, potassium lauryl sulfate, potassium laureth sulfate, sodium decyl sulfate, sodium octyl/decyl sulfate, sodium 2-ethylhexyl sulfate, sodium octyl sulfate, sodium nonoxynol-4 sulfate, sodium nonoxynol-6 sulfate, sodium cumene sulfate, and ammonoium nonoxynol-6 sulfate; sulfonate esters such as sodium α-olefin sulfonate, ammonium xylene sulfonate, sodium xylene sulfonate, sodium toluene sulfonate, dodecyl benzene sulfonate, and lignosulfonates; sulfosuccinate surfactants such as disodium lauryl sulfosuccinate, disodium laureth sulfosuccinate; and others including sodium cocoyl isethionate, lauryl phosphate, any of the ULTRAPHOS series of phosphate esters, Cyastat® 609 (N,N-Bis(2-hydroxyethyl)-N-(3'-Dodecyloxy-2'-Hydroxypropyl) Methyl Ammonium Methosulfate) and Cyastat® LS ((3-Lauramidopropyl) trimethylammonium methylsulfate), available from Cytec Industries.

Exemplary cationic surfactants include quaternary ammonium salts such as dodecyl trimethyl ammonium chloride, cetyl trimethyl ammonium salts of bromide and chloride, hexadecyl trimethyl ammonium salts of bromide and chloride, alkyl dimethyl benzyl ammonium salts of chloride and bromide, and the like. In this regard, surfactants such as Lodyne® S-106A (Fluoroalkyl Ammonium Chloride Cationic Surfactant 28-30%, available from Ciba Specialty Chemicals Corporation) and Ammonyx® 4002 (Octadecyl dimethyl benzyl ammonium chloride Cationic Surfactant, available from Stepan Company, Northfield, Ill.) are particularly preferred.

A class of non-ionic surfactants includes those comprising polyether groups, based on, for example, ethylene oxide (EO) repeat units and/or propylene oxide (PO) repeat units. These surfactants are typically non-ionic. Surfactants having a polyether chain may comprise between about 1 and about 36 EO repeat units, between about 1 and about 36 PO repeat units, or a combination of between about 1 and about 36 EO repeat units and PO repeat units. More typically, the polyether chain comprises between about 2 and about 24 EO repeat units, between about 2 and about 24 PO repeat units, or a combination of between about 2 and about 24 EO repeat units and PO repeat units. Even more typically, the polyether chain comprises between about 6 and about 15 EO repeat units, between about 6 and about 15 PO repeat units, or a combination of between about 6 and about 15 EO repeat units and PO repeat units. These surfactants may comprise blocks of EO repeat units and PO repeat units, for example, a block of EO repeat units encompassed by two blocks of PO repeat units or a block of PO repeat units encompassed by two blocks of EO repeat units. Another class of polyether surfactants comprises alternating PO and EO repeat units. Within these classes of surfactants are the polyethylene glycols, polypropylene glycols, and the polypropylene glycol/polyethylene glycols.

Yet another class of non-ionic surfactants comprises EO, PO, or EO/PO repeat units built upon an alcohol or phenol base group, such as glycerol ethers, butanol ethers, pentanol ethers, hexanol ethers, heptanol ethers, octanol ethers, nonanol ethers, decanol ethers, dodecanol ethers, tetradecanol ethers, phenol ethers, alkyl substituted phenol ethers, α-naphthol ethers, and β-naphthol ethers. With regard to the alkyl substituted phenol ethers, the phenol group is substituted with a hydrocarbon chain having between about 1 and about 10 carbon atoms, such as about 8 (octylphenol) or about 9 carbon atoms (nonylphenol). The polyether chain may comprise between about 1 and about 24 EO repeat units, between about 1 and about 24 PO repeat units, or a combination of between about 1 and about 24 EO and PO repeat units. More typically, the polyether chain comprises between about 8 and about 16 EO repeat units, between about 8 and about 16 PO repeat units, or a combination of between about 8 and about 16 EO and PO repeat units. Even more typically, the polyether chain comprises about 9, about 10, about 11, or about 12 EO repeat units; about 9, about 10, about 11, or about 12 PO repeat units; or a combination of about 9, about 10, about 11, or about 12 EO repeat units and PO repeat units.

An exemplary β-naphthol derivative non-ionic surfactant is Lugalvan BN012 which is a β-naphtholethoxylate having 12 ethylene oxide monomer units bonded to the naphthol hydroxyl group. A similar surfactant is Polymax NPA-15, which is a polyethoxylated nonylphenol. Another surfactant is Triton®-X100 nonionic surfactant, which is an octylphenol ethoxylate, typically having around 9 or 10 EO repeat units. Additional commercially available non-ionic surfactants include the Pluronic® series of surfactants, available from BASF. Pluronic® surfactants include the P series of EO/PO block copolymers, including P65, P84, P85, P103, P104, P105, and P123, available from BASF; the F series of EO/PO block copolymers, including F108, F127, F38, F68, F77, F87, F88, F98, available from BASF; and the L series of EO/PO block copolymers, including L10, L101, L121, L31, L35, L44, L61, L62, L64, L81, and L92, available from BASF.

Additional commercially available non-ionic surfactants include water soluble, ethoxylated nonionic fluorosurfactants available from DuPont and sold under the trade name Zonyl®, including Zonyl® FSN (Telomar B Monoether with Polyethylene Glycol nonionic surfactant), Zonyl® FSN-100, Zonyl® FS-300, Zonyl® FS-500, Zonyl® FS-510, Zonyl® FS-610, Zonyl® FSP, and Zonyl® UR. Zonyl® FSN (Telomar B Monoether with Polyethylene Glycol nonionic surfactant) is particularly preferred. Other non-ionic surfactants include the amine condensates, such as cocoamide DEA and cocoamide MEA, sold under the trade name ULTRAFAX. Other classes of nonionic surfactants include acid ethoxylated fatty acids (polyethoxy-esters) comprising a fatty acid esterified with a polyether group typically comprising between about 1 and about 36 EO repeat units. Glycerol esters comprise one, two, or three fatty acid groups on a glycerol base.

In one preferred embodiment, non-metallic nano-particles are in a pre-mix dispersion with a non-ionic coating on the particles prior to mixing in with the other bath components. Then the dispersion is mixed with the other ingredients, including the acid, deposition metal ions, and a cationic surfactant. A further surfactant coating is deposited over the non-metallic particle in a manner that imparts an overall coating charge, in this instance positive, on the fluoropolymer particles. Preferably, the surfactant coating comprises predominantly of positively charged surfactant molecules. A positively charged surfactant coating will tend to drive the particles, during electrolytic deposition, toward the cathode substrate enhancing co-deposition with the metal and optionally the alloying metal. The overall charge of the surfactant coating may be quantified. The charge of a particular surfactant molecule is typically −1 (anionic), 0 (non-ionic or zwitterionic), or +1 (cationic). A population of surfactant molecules therefore has an average charge per surfactant molecule that ranges between −1 (entire population comprises anionic surfactant molecules) and +1 (entire population comprise cationic surfactant molecules). A population of surfactant molecules having an overall 0 charge may comprise 50% anionic surfactant molecules and 50% cationic surfactant molecules, for example; or, the population having an overall 0 charge may comprise 100% zwitterionic surfactant molecules or 100% non-ionic surfactant molecules.

In one embodiment, the surfactant coating comprises a cationic surfactant used alone or in combination with one or more additional cationic surfactants, such that the average charge per surfactant molecule is substantially equal to +1, i.e., the surfactant coating consists substantially entirely of cationic surfactant molecules.

It is not necessary, however, for the surfactant coating to consist entirely of cationic surfactants. In other words, the surfactant coating may comprise combinations of cationic surfactant molecules with anionic surfactant molecules, zwitterionic surfactant molecules, and non-ionic surfactant molecules. Preferably, the average charge per surfactant molecule of the population of surfactant molecules coating the non-metallic nano-particles is greater than 0, and in a particularly preferred embodiment, the surfactant coating comprises a cationic surfactant used alone or in combination with one or more additional cationic surfactants and with one or more non-ionic surfactants. The surfactant coating comprising a population of cationic surfactant molecules and non-ionic surfactant molecules preferably has an average charge per surfactant molecule between about 0.01 (99% non-ionic surfactant molecules and 1% cationic surfactant molecules) and 1 (100% cationic surfactant molecules), preferably between about 0.1 (90% non-ionic surfactant molecules and 10% cationic surfactant molecules) and 1. The average charge per surfactant molecule of the population of surfactant molecules making up the surfactant coating over the non-metallic particles may be at least about 0.2 (80% non-ionic surfactant molecules and 20% cationic surfactant molecules), such as at least about 0.3 (70% non-ionic surfactant molecules and 30% cationic surfactant molecules), at least about 0.4 (60% non-ionic surfactant molecules and 40% cationic surfactant molecules), at least about 0.5 (50% non-ionic surfactant molecules and 50% cationic surfactant molecules), at least about 0.6 (40% non-ionic surfactant molecules and 60% cationic surfactant molecules), at least about 0.7 (30% non-ionic surfactant molecules and 70% cationic surfactant molecules), at least about 0.8 (20% non-ionic surfactant molecules and 80% cationic surfactant molecules), or even at least about 0.9 (10% non-ionic surfactant molecules and 90% cationic surfactant molecules). In each of these embodiments, the average charge per surfactant molecule is no greater than 1.

The concentration of surfactant is determined by the total particle-matrix interface area. For a given weight concentration of the particle, the smaller the mean particle size, the higher the total area of the particle surface. The total surface area is calculated by the specific particle surface ($m^2/g$) multiplied by the particle weight in the solution (g). The calculation yields a total surface area in $m^2$. A given concentration of non-metallic nano-particles, having a high specific particle surface area, includes a much greater total number of particles compared to micrometer-sized particles of the same weight concentration. As a result, the average inter-particle distance decreases. The interaction between the particles, like the van der waals attraction, becomes more prominent. Therefore, high concentrations of surfactants are used to decrease the particles' tendency to flocculate or coagulate with each other. The surfactant concentration is therefore a function of the mass and specific surface area of the particles. Preferably, therefore, the composition comprises about one gram of surfactant for every about 100 $m^2$ to 200 $m^2$ of surface area of fluoropolymer particles, more preferably about one gram of surfactant for every 120 $m^2$ to about 150 $m^2$ of surface area of fluoropolymer particles.

For example, a dispersion of Teflon° TE-5070AN (total mass 750 grams) has about 450 grams of PTFE particles, having a specific surface area of about 23.0 $m^2/g$ and a total surface area of about 10350 $m^2$. The mass of surfactant for coating and dispersing this total surface area is preferably between 50 grams and about 110 grams, more preferably between about 65 grams and about 90 grams. For example, a composition for dispersing about 450 grams of these PTFE particles may include between about 5 grams and about 25 grams Ammonyx® 4002 (Octadecyl dimethyl benzyl ammonium chloride Cationic Surfactant), between about 5 grams and about 25 grams Zonyl® FSN (Telomar B Monoether with Polyethylene Glycol nonionic surfactant), between about 40 grams and about 60 grams Lodyne® S-106A (Fluoroalkyl Ammonium Chloride Cationic Surfactant 28-30%), between about 30 grams and about 50 grams isopropyl alcohol, and between about 150 grams and about 250 grams $H_2O$. The surfactant coating comprises a combination of cationic surfactant and nonionic surfactant to stabilize the fluoropolymer particles in solution. So, for example, the dispersion can be formed with the following components: PTFE particles (450 grams), Ammonyx® 4002 (10.72 g), Zonyl® FSN (14.37 g), Lodyne® S-106A (50.37 g), isopropyl alcohol (38.25 g), and water (186.29 g).

In the electrolytic plating compositions of the present invention, the nano-particles composed of fluoropolymers are present in a concentration between about 0.1 wt % and about 20 wt %, more preferably between about 1 wt % and about 10 wt %. By adding non-metallic nano-particles to the electrolytic plating compositions at these concentrations, the deposited metal-based composite coating may comprise at least about 1% by weight nano-particle up to about 50% by weight nano-particle.

If the nano-particle source is Teflon® PTFE 30 or Teflon® TE-5070AN, for example, the concentrations in the electrolytic plating composition may be achieved by adding between about 1.5 g and about 350 g of 60 wt. % PTFE dispersion per 1 L of electrolytic plating solution, more preferably between about 15 g and about 170 g of 60 wt. % PTFE dispersion per 1 L of electrolytic plating composition. In volume terms, the concentrations in the electrolytic plating composition may be achieved by adding PTFE dispersion to the solution at a volume of between about 0.5 mL and about 160 mL of PTFE dispersion per 1 L of electrolytic plating composition, more preferably between about 6 mL and about 80 mL of PTFE dispersion per 1 L of electrolytic plating composition. If the fluoropolymer particle source is a source of dry PTFE particles, such as Teflon® TE-5069AN, the concentration in the electrolytic plating composition can be achieved by adding between about 1 g and about 200 g, more preferably between about 10 g and about 100 g, of dry PTFE particles per 1 L of electrolytic plating composition.

The electrolytic plating composition of the present invention comprises, in addition to non-metallic nano-particles and surfactants, a source of deposition metal ions of a deposition metal and other additives as are known in the art pertinent to the electrolytic plating of each particular metal ion. General classes of such additives include conductive salts, brighteners, complexing agents, pH adjusters, and buffering agents.

Deposition metal which may be co-deposited with nano-particles to form the metal-based composite coatings of the present invention include palladium, zinc, nickel, silver, copper, gold, platinum, rhodium, ruthenium, and alloys containing any of these metals. Applicable electrolytic deposition chemistries for the deposition of these deposition metals are discussed in more detail below.

Electrolytic deposition occurs by contacting the surface of the substrate with the electrolytic plating composition. The cathode substrate and anode are electrically connected by wiring and, respectively, to a rectifier (an external source of electrons, i.e., a power supply). The cathode substrate has a net negative charge so that deposition metal ions in the solution are reduced at the cathode substrate depositing the metal-based composite coating on the cathode surface. An oxidation reaction takes place at the anode. The cathode and anode may be horizontally or vertically disposed in the tank.

During operation of the electrolytic plating system, deposition metal ions are reduced onto the surface of a cathode substrate when the rectifier is energized. A pulse current, direct current, reverse periodic current, or other suitable current may be employed. The temperature of the electrolytic solution may be maintained using a heater/cooler whereby electrolytic solution is removed from the holding tank and flows through the heater/cooler and then is recycled to the holding tank.

The mechanism of deposition is co-deposition of the nano-particles and the deposition metal ions. The nano-particles are not reduced, but are trapped at the interface by the reduction of the metal ions, which are reduced and deposited around the nano-particle. The surfactants may be chosen to impart a charge to the nano-particles, which helps to sweep them toward the cathode and temporarily and lightly adhere them to the surface until encapsulated and trapped there by the reducing metal ions. The imparted charge is typically positive.

Electrolytic Palladium

For the deposition of palladium-based composite coating comprising nano-particles, the electrolytic plating solution comprises a source of palladium ions. Palladium-based composite coatings comprising nano-particles have use in a variety of applications. For example, as coatings for electronics parts such as connectors and leadframes, decorative applications such as eyeglasses and pen and pencil sets where corrosion resistance is very important, and for specialty items such ink jets where lowering the surface tension is also important.

Electrolytic plating compositions for the deposition of palladium-based composite coatings may additionally comprise a conductive electrolyte, brighteners, ligands, and a surfactant. An exemplary plating composition for depositing a palladium-based composite coating comprising nano-particles composed of fluoropolymer may comprise:

| | |
|---|---|
| Palladium (as Pd Tetraamine Sulfate) | 10 g/L |
| Ammonium Sulfate | 40 g/L |
| Dibasic Ammonium Phosphate | 40 g/L |
| Allyl Phenyl Sulfone | 0.25 g/L |
| Dodecyl Trimethyl Ammonium Chloride | 0.6 g/L |
| Teflon ® TE-5070AN | 30 mL/L |

Additional palladium plating chemistries are disclosed in the prior art, such as in U.S. Pat. Nos. 6,274,254; 6,139,977; 5,976,344; 5,024,733; 4,911,799; 4,911,798; 4,486,274; 4,468,296; and 4,427,502, the disclosures of which are hereby incorporated in their entirety.

Electrolytic plating compositions for plating palladium-based composites comprising nano-particles can be used to plate bright, glossy coatings, sem-bright coatings, or matte coatings on substrates, depending upon the composition chemistry employed. For some applications, where surface appearance is either desired for cosmetic reasons or required for performance such as wear resistance, a bright, glossy coating is preferred. In a typical plating operation for plating a palladium-based composite, the plating parameters may be as follows:

Plating temperature between 20° C. and 60° C., such as between 25° C. and 35° C.

Current density between 1 amp/dm$^2$ and 100 amp/dm$^2$

Plating rate between 0.05 μm/min and 50 μm/min.

Palladium-based composite coatings may comprise nano-particle contents between about 4 wt. % and about 10 wt. %, more typically between about 4.5 wt. % and about 8.5 wt. %. Preferably, the nano-particles are distributed substantially evenly throughout the plated deposit.

Electrolytic Zinc

For the deposition of zinc-based composite coatings comprising nano-particles, the electrolytic plating bath comprises a source of Zn ions. Zinc-based composite coatings comprising nano-particles have use in a variety of applications. For example, zinc and zinc alloys may be plated as corrosion coatings for automotive parts.

An exemplary plating composition for depositing a zinc-based composite coating comprising nano-particles composed of fluoropolymer may comprise:

| | |
|---|---|
| NaOH | 144 g/L |
| ZnO | 21 g/L |
| Na gluconate | 7.5 g/L |
| Salicylic acid | 6.9 g/L |
| $Fe^{3+}$ ions | 0.555 g/L |
| Teflon ® TE-5070AN | 30 ml/L |

An additionaly exemplary plating composition for depositing a zinc-based composite coating comprising nano-particles composed of fluoropolymer may comprise:

| | |
|---|---|
| Zinc Oxide | 7.5 g/L |
| NaOH | 105 g/L |
| Sodium gluconate | 25 g/L |
| $Co^{2+}$ ions (from $CoSO_4$) | 75 mg/L |
| $Fe^{2+}$ ions (from $FeSO_4$) | 50 mg/L |
| MIRAPOL ® | 1.4 g/L |
| Teflon ® TE-5070AN | 30 ml/L |

Additional zinc plating chemistries are disclosed in the prior art, such as in U.S. Pat. Nos. 5,435,898 and 6,080,447, the disclosures of which are hereby incorporated in their entirety.

Electrolytic Tin

For the deposition of tin-based composite coatings comprising nano-particles, the electrolytic plating bath comprises a source of Sn ions. Tin-based composite coatings comprising nano-particles have use in a variety of applications. For example, tin and tin alloys may be used as solders or as coatings over lead frames and connectors.

Electrolytic plating compositions for the deposition of tin-based composite coatings may additionally comprise a conductive salts, pH adjusting agents particularly strong acids, surfactants, grain refiners, and anti-oxidants.

An exemplary plating composition for depositing a tin-based composite coating comprising nano-particles composed of fluoropolymer may comprise:

| | |
|---|---|
| Tin methane sulfonate | 40-80 g/L |
| Methane sulfonic acid | 100-200 g/L |
| Wetting Agent 300 (Lucent ECS) | 5-15 g/L |
| Anti-Oxidant C1 (Lucent ECS) | 1-3 g/L |
| Teflon ® TE-5070AN | 30 ml/L |

Another exemplary plating composition for depositing a tin-based composite coating comprising nano-particles composed of fluoropolymer may comprise:

| | |
|---|---|
| Tin methane sulfonate | 40-80 g/L |
| Methane sulfonic acid | 100-200 g/L |
| Stannostarr Additives | 1-15 g/L |
| Teflon ® TE-5070AN | 30 ml/L |

Another exemplary plating composition for depositing a tin-based composite coating comprising nano-particles composed of fluoropolymer may comprise:

| | |
|---|---|
| Tin sulfate | 24 g/L |
| Concentrated H2SO4 | 9.7% (by volume) |
| Triton X-100 | 3.75 g/L |
| Methacrylic acid | 0.04 g/L |
| Benzylidene acetone | 0.04 g/L |
| Teflon ® TE-5070AN | 30 ml/L |

Additional tin plating chemistries are disclosed in the prior art, such as in U.S. Pat. No. 5,061,351; U.S. Pub. No. 20030025182; and U.S. Pub. No. 20050249968, the disclosures of which are hereby incorporated in their entirety.

Electrolytic Nickel

For the deposition of nickel-based composite coatings comprising nano-particles, the electrolytic plating bath comprises a source of Ni ions. Nickel-based composite coatings comprising nano-particles have use in a variety of applications. For example, nickel and nickel alloys may be used as protective coatings over copper substrates, such as copper lead frames.

Electrolytic plating compositions for the deposition of nickel-based composite coatings may additionally comprise buffering agents and wetting agents, especially fluorinated alkyl quaternary ammonium iodide or perfluoro dodecyl trimethyl ammonium fluoride.

An exemplary plating composition for depositing a nickel-based composite coating comprising nano-particles composed of fluoropolymer may comprise:

| | |
|---|---|
| Nickel (as $Ni(NH_2SO_3)_2$) | 120 g |
| Nickel salt ($NiCl_2 \cdot 6H_2O$) | 5 g |
| $H_3BO_3$ | 30 g |
| Fluorinated alkyl quaternary ammonium iodide | 10 ppm |
| Teflon ® TE-5070AN | 30 ml/L |

Another exemplary plating composition for depositing a nickel-based composite coating comprising nano-particles composed of fluoropolymer may comprise:

| | |
|---|---|
| Ni sulfamate | 319-383 g/L |
| $NiCl_2 \cdot 6H_2O$ | 5-15 g/L |
| $H_3BO_3$ | 20-40 g/L |
| Sodium Lauryl Sulfate | 0.2-0.4 g/L |
| Teflon ® TE-5070AN | 30 ml/L |

Additional nickel plating chemistries are disclosed in the prior art, such as in U.S. Pat. Nos. 6,399,220; 6,090,263; 5,916,696; U.S. Pub. No. 20030025182; and U.S. Pub. No. 20050249968, the disclosures of which are hereby incorporated in their entirety.

Electrolytic Silver

For the deposition of silver-based composite coatings comprising nano-particles, the electrolytic plating bath comprises a source of Ag ions. Silver-based composite coatings comprising nano-particles have use in a variety of applications. For example, silver and silver alloys may be used as protective coatings over copper substrates.

Electrolytic plating compositions for the deposition of silver-based composite coatings may additionally comprise a complexing agent, surfactants, conductive electrolyte, grain refiners, and tarnish inhibitors.

An exemplary plating composition for depositing a silver-based composite coating comprising nano-particles composed of fluoropolymer may comprise:

| | |
|---|---|
| $Ag_2O$ | 116 g/L |
| 1,3-diaminopropane | 113 g/L |
| potassium hydrogen phosphate | 173 g/L |
| Teflon ® TE-5070AN | 30 ml/L |

Another exemplary plating composition for depositing a silver-based composite coating comprising nano-particles composed of fluoropolymer may comprise:

| | |
|---|---|
| $AgNO_3$ | 17 g/L |
| 1,3-diaminopropane | 22 g/L |
| $KNO_3$ | 101 g/L |
| Teflon ® TE-5070AN | 30 ml/L |

Another exemplary plating composition for depositing a silver-based composite coating comprising nano-particles composed of fluoropolymer may comprise:

| | |
|---|---|
| $AgNO_3$ | 0.79 g/L |
| N-(2-hydroxyethyl)ethylenediamine triacetic acid | 10 g/L |
| benzimidazole | 1 g/L |
| 3,5-dinitrohydroxy benzoic acid | 1 g/L |
| non-ionic surfactant EO/PO block co-polymer | 1 g/L |
| Polyethylene glycol | 0 g/L |
| $HNO_3$ | 0.98 g/L |
| Teflon ® TE-5070AN | 30 ml/L |

Additional silver plating chemistries are disclosed in the prior art, such as in U.S. Pat. No. 4,478,691 and U.S. Pub. No. 20060024430, the disclosures of which are hereby incorporated in their entirety.

Electrolytic Gold

For the deposition of gold-based composite coatings comprising nano-particles, the electrolytic plating bath comprises a source of Au ions. Gold-based composite coatings comprising nano-particles have use in a variety of applications. For example, gold and gold alloys may be used as a decorative coating in jewelry and in the electronics industry as an electrical contact finish (including hard gold).

Electrolytic plating compositions for the deposition of gold-based composite coatings may additionally comprise an oxygen scavenger or alkali metal pyrophosphate to protect against oxidation, brighteners, and complexing agents.

An exemplary plating composition for depositing a gold-based composite coating comprising nano-particles composed of fluoropolymer may comprise:

| | |
|---|---|
| Gold (as metal) | 8-15 g/L |
| Sodium gold sulfite | 25-40 g/L |
| Brightener | 4-12 mL/L |
| Sodium pyrophosphate | 15-60 g/L |
| Teflon ® TE-5070AN | 30 ml/L |

Additional gold plating chemistries are disclosed in the prior art, such as in U.S. Pat. Nos. 6,126,807 and 6,423,202, the disclosures of which are hereby incorporated in their entirety.

Electrolytic Platinum

For the deposition of platinum-based composite coatings comprising nano-particles, the electrolytic plating bath comprises a source of Pt ions. Platinum-based composite coatings comprising nano-particles have use in a variety of applications. For example, platinum and platinum alloys are widely used in plating jewelry. In the electrical arts protective films made of platinum are used as conduction paths in electrical circuits and as contact surfaces in devices with electrical contacts.

Electrolytic plating compositions for the deposition of platinum-based composite coatings may additionally comprise acomplexing agent and a conductive salt.

An exemplary plating composition for depositing a platinum-based composite coating comprising nano-particles composed of fluoropolymer may comprise:

| | |
|---|---|
| $PtCl_2$ | 20.0 g/L |
| Diethylenetriamine and phosphate buffer | 15.5 g/L |
| Teflon ® TE-5070AN | 30 ml/L |

Another exemplary plating composition for depositing a platinum-based composite coating comprising nano-particles composed of fluoropolymer may comprise:

| | |
|---|---|
| $Pt(NO_3)_2$ | 0.05 M |
| Diethylenetriamine | 0.1 M |
| $KNO_3$ | 0.4 M |
| Teflon ® TE-5070AN | 30 ml/L |

Additional platinum plating chemistries are disclosed in the prior art, such as in U.S. Pat. No. 4,427,502, the disclosure of which is hereby incorporated in its entirety.

Electrolytic Rhodium

For the deposition of rhodium-based composite coatings comprising nano-particles, the electrolytic plating bath comprises a source of Rh ions. Rhodium-based composite coatings comprising nano-particles have use in a variety of applications. For example, rhodium and rhodium alloys is used widely in jewelry. Moreover, rhodium plating is used for electrical contacts.

An exemplary plating composition for depositing a rhodium-based composite coating comprising nano-particles composed of fluoropolymer may comprise:

| | |
|---|---|
| rhodium from rhodium sulfate | 2 to 8 g/L |
| sulfuric acid | 50 g/L |
| Rho Tech brightener | 150 mL/L |
| Teflon ® TE-5070AN | 30 ml/L |

Rhodium plating chemistries and methods for rhodium plating are disclosed in the prior art, such as in U.S. Pat. No. 6,241,870, the disclosure of which is hereby incorporated in its entirety.

Alloys

A variety of metal-based composite coatings comprising two or more of the above-described metals may be co-deposited with nano-particles. In one embodiment, the metal-based composite coating comprises silver and tin co-deposited with nano-particles. In one embodiment, the metal-based composite coating comprises gold and tin co-deposited with nano-particles.

In one embodiment, the metal-based composite coating additionally comprises a refractory metal ion, such as W, Mo, or Re, which functions to increase thermal stability, corrosion resistance, and diffusion resistance. The inclusion of a refractory metal ion is particularly suitable in nickel-based composite coatings.

Exemplary sources of W ions are tungsten trioxide, tungstic acids, ammonium tungstic acid salts, tetramethylammonium tungstic acid salts, and alkali metal tungstic acid salts, phosphotungstic acid, silicotungstate, other heteropolytungstic acids and other mixtures thereof. For example, one preferred deposition bath contains between about 0.1 g/L and about 10 g/L of tungstic acid. Exemplary sources of molybdenum include molybdate salts such as $MoO_3$ predissolved with TMAH; $(NH_4)_2MoO_4$; $(NH_4)_2Mo_2O_7$; $(NH_4)_6Mo_7O_{24}.4H_2O$; $(NH_4)_2Mo_3O_{10}.2H_2O$; $(NH_4)_6Mo_8O_{27}.4H_2O$; dimolybdates ($Me_2Mo_2O_7.nH_2O$); trimolybdates ($Me_2Mo_3O_{10}.nH_2O$); tetramolybdates ($Me_2Mo_4O_{13}$); metamolybdates ($Me_2H_{10-m}[H_2(Mo_2O_7)_6].nH_2O$; wherein m is less than 10); hexamolybdates ($Me_2Mo_6O_{19}.nH_2O$); octamolybdates ($Me_2Mo_8O_{25}.nH_2O$); paramolybdates ($Me_2Mo_7O_{22}.nH_2O$ and $Me_{10}Mo_{12}O_{41}.nH_2O$); wherein in the above Me is a counterion selected from among ammonium, tetramethylammonium, and alkali metal cations and wherein n is an integer having a value corresponding to a stable or metastable form of the hydrated oxide; molybdic acids; molybdic acid salts of ammonium, tetramethylammonium, and alkali metals; heteropoly acids of molybdenum; and other mixtures thereof. Exemplary sources of Re metal include rhenium trioxides, perrhenic acids, ammonium perrhenic acid salts, tetramethylammonium perrhenic acid salts, alkali metal perrhenic acid salts, heteropolyacids of rhenium, and other mixtures thereof.

Parameters Indicative of Corrosion Resistance and Surface Lubricity

The increased corrosion resistance can be measured, in part, by the increase in interfacial contact angle at the coating/air/water interface of the metal-based composite coating of the present invention compared to a pure tin coating. Highly hydrophobic, and thus corrosion resistant surfaces, are characterized by contact angles above about 70°. For example, the contact angle of a pure palladium deposit was between about 38° and about 44°, indicating a relatively non-hydrophobic coating. A palladium-based composite coating comprising between about 0.01 wt % about 2.6 wt % nano-particles composed of fluoropolymer having an average particle size between about 0.3 μm (300 nm) and about 0.5 μm (500 nm) had a higher interfacial contact angle between about 40° and about 120°, indicating its relatively higher hydrophobicity. A highly hydrophobic coating comprises a palladium-based composite coating comprising between about 4.5 wt % about 8.5 wt % nano-particles composed of fluoropolymer having an average particle size between about 0.05 μm (50 nm) and about 0.1 μm (100 nm), which had a significantly higher interfacial contact angle between about 80° and about 130°.

Other tests for determining the quality of metal-based composite coatings comprising nano-particles include porosity testing as measured by ASTM B799 $SO_2$ Vapor Testing, and reflectance testing.

The following examples further illustrate the present invention.

EXAMPLE 1

Palladium-Based Composite Comprising Nano-Particles Composed of Fluoropolymer Three baths were prepared to for the deposition of A) Palladium, B) Palladium-based composite comprising relatively large nano-particles composed of fluoropolymer, and C) Palladium-based composite comprising nano-particles composed of fluoropolymer of the invention.

| Bath A) Palladium | |
|---|---|
| Palladium (as Pd Tetraamine Sulfate) | 10 g/L |
| Ammonium Sulfate | 40 g/L |
| Dibasic Ammonium Phosphate | 40 g/L |
| Allyl Phenyl Sulfone | 0.25 g/L |
| Dodecyl Trimethyl Ammonium Chloride | 0.6 g/L |

Balance of DI water to 1 L

| Bath B) Palladium-based composite comprising fluoropolymer particles with mean particle size between about 0.3 μm (300 nm) and about 0.5 μm (500 nm) | |
|---|---|
| Palladium (as Pd Tetraamine Sulfate) | 10 g/L |
| Ammonium Sulfate | 40 g/L |
| Dibasic Ammonium Phosphate | 40 g/L |
| Allyl Phenyl Sulfone | 0.25 g/L |
| Dodecyl Trimethyl Ammonium Chloride | 0.6 g/L |
| Teflon ® PTFE 30 | 30 mL/L |

Balance of DI water to 1 L

| Bath C) Palladium-based composite comprising fluoropolymer particles with mean particle size between about 0.05 μm (50 nm) and about 0.07 μm (70 nm) | |
|---|---|
| Palladium (as Pd Tetraamine Sulfate) | 10 g/L |
| Ammonium Sulfate | 40 g/L |
| Dibasic Ammonium Phosphate | 40 g/L |
| Allyl Phenyl Sulfone | 0.25 g/L |
| Dodecyl Trimethyl Ammonium Chloride | 0.6 g/L |
| Teflon ® TE-5070AN | 30 mL/L |

Balance of DI water to 1 L

Coatings were deposited under similar conditions from each from each bath, and subjected to EDS measurements, contact angle measurements, porosity tests, and reflectance measurements. The results are shown in Table I.

TABLE I

Physical Properties of Alloy Coatings

| Test | Palladium Coating of Bath A | Palladium-based Composite Coating of Bath B | Palladium-based Composite Coating of Bath C |
|---|---|---|---|
| EDS Measurement | 0% PTFE | 0.0 to 2.6% PTFE | 4.5 to 8.5% PTFE |
| Interfacial Contact Angle | 38 to 44° | 40 to 120° | 80 to 130° |
| Porosity Testing (ASTM B799, $SO_2$ Vapor Test) | | | |
| Reflectance Measurements | | | |

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

We claim:

1. A method for imparting corrosion resistance onto a surface of a substrate, the method comprising:

contacting the surface with an electrolytic plating composition comprising (a) a source of deposition metal ions of a deposition metal selected from the group consisting of zinc, palladium, silver, nickel, copper, gold, platinum, rhodium, ruthenium, chrome, and alloys thereof, (b) fluoropolymer particles having a mean particle size between about 50 and about 150 nanometers and are characterized by a particle size distribution in which at least about 30 volume % of the particles have a particle size less than 100 nm and wherein the fluoropolymer particles have surfactant coatings with an average charge per surfactant molecule of between +0.1 and +1, (c) a cationic quaternary ammonium halide surfactant selected from the group consisting of dodecyl trimethyl ammonium chloride, cetyl trimethyl ammonium salts of bromide and chloride, hexadecyl trimethyl ammonium salts of bromide and chloride, and alkyl dimethyl benzyl ammonium salts of chloride and bromide, and (d) a fluoroalkyl ammonium cationic surfactant, wherein the electrolytic plating composition comprises about one gram of surfactant for every 100 $m^2$ to about 150$m^2$ of surface area of fluoropolymer particles and wherein; and applying an external source of electrons to the electrolytic plating composition to thereby electrolytically deposit the composite coating onto the surface, wherein the composite coating comprises metal and the fluoropolymer particles.

2. The method of claim 1 wherein the fluoropolymer particles have a mean particle size between about 50 and about 100 nanometers.

3. The method of claim 1, wherein the fluoropolymer nano-particles have a pre-mix coating of surfactant molecules thereon.

4. The method of claim 3 wherein the fluoropolymer particles have a mean particle size between about 50 and about 100 nanometers.

5. The method of claim 3 wherein the fluoropolymer nano-particles are characterized by a particle size distribution in which at least about 50volume % of the particles have a particle size less than 100 nm.

6. The method of claim 3 wherein the surface tension of the electrolytic plating composition is between about 40 dyne-cm and about 70 dyne-cm.

7. The method of claim 3 wherein the electrolytic plating composition further comprises a non-ionic surfactant.

8. The method of claim 3 wherein the deposition metal comprises silver.

9. The method of claim 3 wherein the deposition metal comprises nickel.

10. The method of claim 3 wherein the surfactant coating on the fluoropolymer nano-particles has an average charge per surfactant molecule of between +0.7 and +1.

11. The method of claim 1, wherein the deposition metal is selected from the group consisting of palladium, silver, nickel, gold, and alloys thereof.

12. The method of claim 11 wherein the electrolytic plating solution comprises a concentration of fluoropolymer nano-particles of between about 1wt. % and about 10 wt. % of the electrolytic plating solution.

13. The method of claim 12 wherein the fluoropolymer particles have a mean particle size between about 50 and about 100 nanometers.

14. The method of claim 11 wherein the fluoropolymer particles have a mean particle size between about 50 and about 100 nanometers.

15. The method of claim 11 wherein the composite coating comprises the deposition metal and between about 1 wt . % and about 5 wt. % of the fluoropolymer nano-particles.

16. The method of claim 11 wherein the fluoropolymer nano-particles are characterized by a particle size distribution in which at least about 50volume % of the particles have a particle size less than 100 nm.

17. The method of claim 16 wherein the fluoropolymer particles are characterized by a particle size distribution in which at least about 30volume % of the particles have a particle size less than 80 nm.

18. The method of claim 11 wherein the fluoropolymer nano-particles have a mean particle size between about 50 and about 100 nanometers, and wherein at least about 30 volume % of the particles have a particle size less than 80 nm.

19. The method of claim 18 wherein the composite coating comprises the deposition metal and between about 1 wt. % and about 5 wt. % of the fluoropolymer nano-particles.

20. The method of claim 11 wherein the surface tension of the electrolytic plating solution is between about 40 dyne-cm and about 70 dyne-cm.

21. The method of claim 11 wherein the deposition metal comprises palladium.

22. The method of claim 11 wherein the electrolytic plating composition further comprises a non-ionic surfactant.

23. The method of claim 11 wherein the deposition metal comprises silver.

24. The method of claim 11 wherein the deposition metal comprises nickel.

25. The method of claim 11 wherein the surfactant coating on the fluoropolymer nano-particles has an average charge per surfactant molecule of between +0.7 and +1.

26. The method of claim 1 wherein the fluoropolymer nano-particles are characterized by a particle size distribution in which at least about 50 volume % of the particles have a particle size less than 100 nm.

27. The method of claim 1 wherein the surface tension of the electrolytic plating composition is between about 40 dyne-cm and about 70 dyne-cm.

28. The method of claim 1 wherein the composite coating contains between about 1 wt. % and about 5 wt. % of fluoropolymer particles.

29. The method of claim 1 wherein the electrolytic plating composition further comprises a non-ionic surfactant.

30. The method of claim 1 wherein the surfactant coating on the fluoropolymer particles has an average charge per surfactant molecule of between +0.7 and +1.

* * * * *